US007100347B2

(12) United States Patent
Hyodo

(10) Patent No.: US 7,100,347 B2
(45) Date of Patent: Sep. 5, 2006

(54) AUTOMATIC OPENING DEVICE FOR SOLID MATERIAL PACKAGE, PREPARATION DEVICE FOR PHOTOGRAPHIC-PROCESSING SOLUTION, AND PHOTOGRAPHIC-PROCESSING DEVICE

(75) Inventor: Tomoyoshi Hyodo, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 26 days.

(21) Appl. No.: 11/042,088

(22) Filed: Jan. 26, 2005

(65) Prior Publication Data

US 2005/0163601 A1 Jul. 28, 2005

(30) Foreign Application Priority Data

Jan. 26, 2004 (JP) ..... P.2004-016614

(51) Int. Cl.
*B65B 43/38* (2006.01)

(52) U.S. Cl. ..... 53/382.1; 414/403

(58) Field of Classification Search ..... 53/381.1, 53/382.1, 492; 414/403, 411, 412
See application file for complete search history.

(56) References Cited

U.S. PATENT DOCUMENTS 2,459,678 A * 1/1949 Berch ..... 455/80
2,852,900 A * 9/1958 Egleston et al. ..... 53/382.1
2,860,467 A * 11/1958 Clemens et al. ..... 53/382.1
2,871,640 A * 2/1959 Truini ..... 53/382.1
2,871,641 A * 2/1959 Tobey ..... 53/382.1
4,548,539 A * 10/1985 Nagashino ..... 414/412

FOREIGN PATENT DOCUMENTS

| | | | |
|---|---|---|---|
| JP | 4-338943 | A | 11/1992 |
| JP | 5-90494 | U | 12/1993 |
| JP | 10-198016 | A | 7/1998 |
| JP | 2000-181044 | A | 6/2000 |
| JP | 2003-307825 | A | 10/2003 |

* cited by examiner

*Primary Examiner*—Louis Huynh
(74) *Attorney, Agent, or Firm*—Sughrue Mion, PLLC

(57) ABSTRACT

An opening device for a solid material package includes a package supporting unit for fixedly supporting a main body of a solid material package having a pair of pulling flaps, an opening unit formed from grips for gripping the pair of pulling flaps so that an opening angle formed by the pair of pulling flaps is 10° to 180°, a pair of movable pieces for supporting the grips, and pulling units for pulling the pair of movable pieces to open the package, and a moving unit for moving the package supporting unit upward in conjunction with the pulling unit such that the solid material package is caused to move upward as the movable pieces grip the pulling flaps with the grips and the pulling units pull the movable pieces within the opening angle to peel off a seal section of the solid material package to discharge the solid material from the package.

14 Claims, 8 Drawing Sheets

AUTOMATIC OPENING DEVICE FOR SOLID MATERIAL PACKAGE, PREPARATION DEVICE FOR PHOTOGRAPHIC-PROCESSING SOLUTION, AND PHOTOGRAPHIC-PROCESSING DEVICE

BACKGROUND OF THE INVENTION

1. Field of the Invention

The present invention relates to an automatic opening device for a solid material package in which a solid material is housed. The invention also relates to a device for easily taking out a photographic-processing agent from a photographic-processing agent vessel without touching the same, preparing a processing solution, and further processing a photosensitive material. More specifically, the invention relates to an automatic opening device for a solid material such as a solid photographic-processing agent; a processing solution preparation device for photosensitive material and a processing agent/processing solution replenishment device, both devices utilizing the automatic opening device; and a photosensitive material processing device equipped with the replenishment device.

2. Description of the Related Art

Processing of a photosensitive material is generally performed through processes of sequentially soaking the photosensitive material in a plurality of processing tanks, such as a color development tank, and a bleach-fix tank. In processing processes, processing solutions in the respective tanks are deteriorated by the effects of other processing solutions, and the like which are brought into together with the photo-sensitive material from the preceding process. Therefore, replenishers are added to the respective tanks in accordance with a processed amount of the photosensitive materials or the like. The replenisher is prepared from a photographic-processing agent.

When a photographic-processing agent is liquid, constituent chemicals are prone to problems such as deterioration or crystallization due to fluctuation in temperature. Furthermore, being large in weight and volume, a liquid photographic-processing agent is inconvenient in terms of transportation, storage space and handling. In addition, packaging materials such as a plastic bottle or plastic bag have been used for containers for photographic-processing agents, and curtailing use of such packaging materials has been desired. For the above reasons, solid photographic-processing agents of a tablet or granular form have come into wider use as photographic processing agents than liquid processing agents. When a photographic-processing agent is solidified, simple packages can be used, which also brings about cost advantages.

In view of the above, JP-A 4-338943 discloses a gable-top type container which is appropriate for housing solid photographic-processing agents.

Meanwhile, when an automatic solution preparation device is employed, for the purpose of assuring operational safety and labor-saving, in the course of preparation of a processing solution from a photographic-processing agent, an operator can prepare the processing solution without touching chemicals.

Also in this case, an automatic solution preparation device making use of a solid processing agent is advantageous. Furthermore, an automatic processor which incorporates such an automatic solution preparation-and-replenishment mechanism for solid processing agent, or an automatic processor in which a solid replenishment agent is dispensed directly in to a processing tank has been disclosed (e.g., JP-A 2003-307825).

Such a solid processing agent, an automatic solution preparation device making use of a solid processing agent, an automatic processor, and the like have many advantages, including reduction in volume of processing agents, curtailment of usage of packaging materials, easing restrictions on mechanical strength on packaging materials, and reduction in air oxidation of processing agents caused by solidification. Conversely, the agent and devices involve the problems described below.

When a solid processing agent is dispensed in a solution preparation device, in the case where the solid processing agent is a tablet or tabular agent, splashing occurs, whereby the processing agent of acid or alkali is likely to come into contact with and stick to an operator. In addition, in some cases an operator must open a package and take out a solid processing agent from the package, and then put it in a solution preparation device.

In addition, in the case where the processing agent is powder, since powder becomes airborne at the time of dispensing, a person who prepares the solution is exposed to a danger of inhaling chemicals. Furthermore, opening a package and dispensing by hand poses a danger of touching chemicals or splashing of chemicals. Accordingly, eliminating the tasks of manually opening and dispensing has been desired.

In addition, since a solid processing agent tends to adhere to a package and persist therein, the package cannot be thrown away as is, and must be cleaned. Such remaining chemicals cause changes in compositions of the processing agent, and immediate improvement in this respect has also been desired.

JP-UM-A 5-90494 discloses a method for smoothly removing a solid processing agent from a package, wherein a hook with a pull-string is disposed on a member forming a lip at an opening of a container, and a package is opened by pulling the string. However, rendering pulling strength uniform has been found to be difficult, and discharging solid agent within a short period of time without allowing residues has been also found to be difficult.

JP-A 2000-181044 discloses a package for housing a solid material having a double structure consisting of an outer packaging material for mechanically protecting the package from the outside and a barrier bag in which a solid agent is housed. The package is advantageous in stability when being attached to a processing solution preparation tank in a highly humid working environment, or when being assembled into a development processor. However, the package is disadvantageous in the aspects of cost of packages and handling in opening.

JP-A 10-198016 discloses a container for photographic-processing agent and an opening-and-supply device for the same.

As described above, desire has arisen for an appropriate opening method for smoothly discharging a solid material housed in a simple package within a short period of time without allowing residues even in a comparatively hot and humid environment, and application thereof to a solid photographic-processing agent. The present invention has been conceived in view of such a background.

SUMMARY OF THE INVENTION

A first object of the invention is to provide an automatic opening device for a solid material package. This device enables removal of a solid material; e.g., a solid photographic-processing agent, housed in a so-called gable-top type paper container used for a milk carton or a liquor carton, or a film package container through use of a sealing method of so-called gusset pouch. The automatic opening device can mechanically and automatically open the solid material package without splashing the solid material, irrespective of whether the solid material is in the form of powder, granular, or a tablet. Hence, the solid material can be removed without being directly touched by an operator.

A second object of the invention is to provide an automatic preparation device for photographic-processing solution which is equipped with the automatic opening device, and which opens the solid material package automatically and dispenses the contents in a processing solution preparation tank, thereby preparing a processing solution.

A third object of the invention is to provide a photosensitive material processing device which is equipped with the automatic opening device, and which automatically opens the solid material package and dispenses a processing agent in an automatically-opened package as a replenisher directly into a processing tank; or a photosensitive material processing device which is equipped with the automatic opening device, and which automatically effects replenishment by means of dispensing the solid material in an automatically-opened package in a replenishment tank or a replenisher preparation tank.

To achieve the first object, the inventor has investigated various means in search of such means that, according to the means, when a package—wherein a solid material is housed in a so-called gable-top type paper container used for a milk carton or a liquor carton, or a film package container making use of a sealing method of a so-called gusset pouch—is opened in an inverted state, the contents drop rapidly without sticking to an inner wall of the container. As a result, an opening condition meeting the object has been found, thereby leading to the below-described invention.

(1) An opening device for a solid material package including:

a package supporting unit for fixedly supporting a main body of a solid material package which is constructed such that a solid material is housed in a prism-like container having an opening section at a top constituted of a seal section and a pair of pulling flaps formed by means of extending an outer edge of the seal section on a top-most side;

an opening unit formed from grips for gripping the pair of pulling flaps of the opening section, a pair of movable pieces for supporting the grips, and pulling units for pulling the pair of movable pieces to thus effect opening of the package; and a moving unit which causes the package supporting unit to move upward only a distance corresponding to a vertical difference between a height of the package in a completely-opened state and that before opening in conjunction with moving of the opening unit, wherein an opening angle formed by the pair of pulling flaps is 10 to 180°; and the movable pieces grip the pulling flaps with the grips, the pulling units pulls the movable pieces within the opening angle formed by the pulling flaps, whereby the solid material package is caused to move upward, the seal section is peeled off to effect opening, and the solid material is discharged from the package.

(2) An opening device for a solid material package including:

a package supporting unit for fixedly supporting a main body of a solid material package which is constructed such that a solid material is housed in a prism-like container having an opening section at a top constituted of a seal section and a pair of pulling flaps formed by means of extending an outer edge of the seal section on a top-most side; and an opening unit formed from grips for gripping the pair of pulling flaps of the opening section, a pair of movable pieces for supporting the grips, and pulling unit for pulling the pair of movable pieces to thus effect opening of the package, wherein an opening angle formed by the pair of pulling flaps is 10 to 120°; the movable pieces grip the pulling flaps with the grips; the pulling units pull the movable pieces within the opening angle of the pulling flaps, whereby the sealing section is peeled off to thus effect opening, and the solid material is discharged from the package.

(3) The opening device for a solid material package according to (1) or (2), wherein each of the grips for gripping the pulling flaps is a pinching jig that pinches opposite sides of the pulling flap so as not to allow sliding.

(4) The opening device for a solid material package according to (1) or (2), wherein each of the grips for gripping the pulling flaps is a jig having a protrusion that fits in a hole formed in the pulling flap.

(5) The opening device for a solid material package according to any one of items (1) to (4), wherein the solid material housed in the solid material package is a solid photographic-processing agent.

(6) A photographic-processing solution preparation device which incorporates the opening device for solid material package according to any one of (1) to (5) as supply means of solid material.

(7) A photographic-processing device which incorporates the opening device for a solid material package according to any one of (1) to (5) as replenisher supply means.

The invention is characterized in that an opening angle formed by the pair of pulling flaps disposed at the top of the solid material package is set to 120° or smaller; or, in a case where the opening angle is 120° or larger, the container of the package is lifted upward in conjunction with opening by means of pulling at least the pulling flaps. By virtue of the opening method, effects of the invention described below will be exerted.

Employing an automatic opening device for a solid material package of the invention enables mechanical and automatic opening of a package to take out a solid material housed in a so-called gable-top type paper container used for a milk carton or a liquor carton, or a film package container making use of sealing method of a so-called gusset pouch without splashing the solid material or allowing residues to remain inside the container. Furthermore, when the automatic opening device is applied to opening of a package of a photographic-processing agent in a solid photographic-processing solution preparation device, a photographic-processing device of a type in which a replenisher is dispensed directly in a processing tank, or a photographic-processing device of a type in which replenishment is effected by means that a solid processing agent in an automatically opened package is dispensed in a replenishment tank or a replenisher preparation tank, a solid processing agent can be discharged from a container smoothly, within a short period of time, and in a safe manner.

DETAILED DESCRIPTION OF THE INVENTION

[Container for Solid Material]

First, a container for solid material used in the automatic opening device of the invention will be described.

Figure 1:
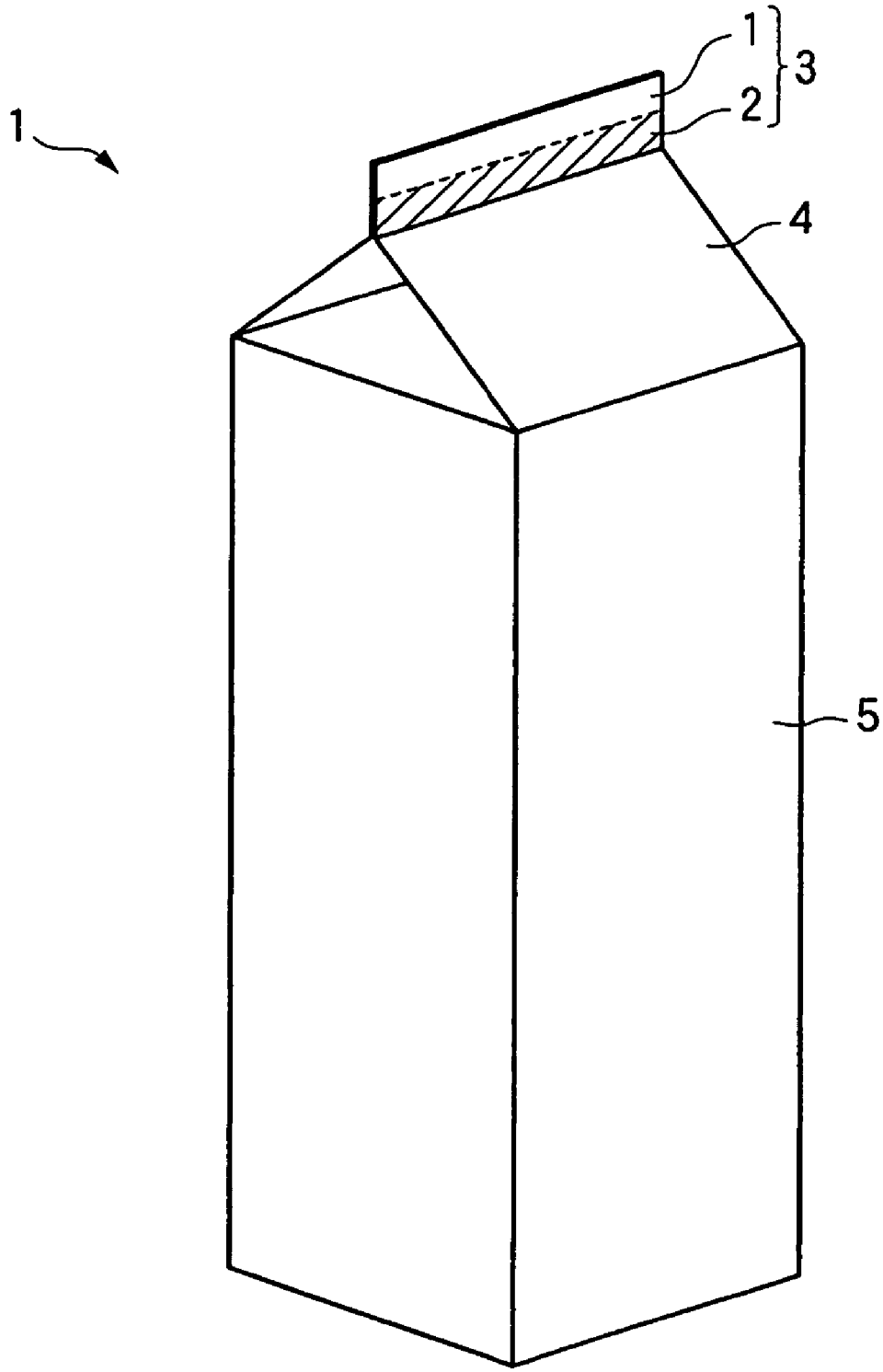
FIG. 1 is a perspective view showing a configuration of a gable-top type container used for the invention.

A solid material package used in the invention has such a structure that a solid material is housed in a gable-top type paper container or a gusset-pouch-type film container. Accordingly, the description will be provided while a gable-top-type container is taken as an example. FIG. 1 is a perspective view showing a configuration of a gable-top-type container used for the invention. FIG. 1 shows that the gable-top type container is formed from an opening section 3 constituting the top, a roof section 4 continuous with the opening section 3, and a prism-like container main body 5 adjacent to the roof section 4.

The opening section 3 is formed by extending the single sheet material common to the container main body 5 and the roof section 4. The opening section 3 comprises a seal section 2 adjacent to the roof section 4 which is 3 to 20 mm in width, and a pulling flap 1 disposed on the top-most section of the container located further upward of the seal section 2. The pulling flap 1 is disposed on the top of the container as a portion gripped by grips at a time of opening. A pair of pulling flaps 1, which are continuous with opposite faces of the container main body 5, contact each other but are not adhered to each other. Accordingly, a pair of grips can grip the pair of pulling flaps 1 individually. The pulling flap 1 is 7 to 40 mm in width, preferably 7 to 30 mm. When the width of the pulling flap 1 is small, gripping becomes uncertain; and when thick, opening motion becomes unnecessarily large.

The seal section 2, located between the pulling flap 1 and the roof section 4, seals opposite faces of the container, thereby sealing the container. An arbitrary known sealing compound, of either a heat seal type or a solvent type, can be employed so long as it does not hinder the opening method of the invention, and a sealing compound of a heat seal type is preferably employed. For instance, a known sealing compound used for a milk carton or the like is preferable for a gable-top-type container used for the invention.

A barrier packaging material is preferably employed as the material constituting the gable-top-type container, from the viewpoint of various types of stability. The material is selected from a sheet of water-vapor barrier paper; plastic; laminated paper; a plastic/paper laminated material; a metal-foil/plastic laminated material; a film obtained by depositing aluminum, glass, or silica on a PET substrate; or a combined composition material thereof, which can be formed into a prism-shaped package, and which has flexibility to allow pulling. Specific examples of a preferable material include a composite material having a structure of PE/paper/PE/aluminum foil/PET/PE/PEF, that of PE/paper/PE/aluminum foil/PET/PE, and that of PE/paper/PE/aluminum foil/PE.

A material having water-vapor permeability and oxygen permeability of 200 $mL/m^2 \cdot 24$ hrs·Pa or less, respectively, is preferable. In addition, the oxygen permeability coefficient can be determined from a method described in "$O_2$ permeation of plastic container" (Modern Packing, N. J. Calyan, 1968, December) PP. 143–145. As a high-barrier packaging material, those described in "New Development of Functional Packaging Materials" (Toray Research Center, February, 1990) can be used.

The container having low oxygen permeability and low water-vapor permeability as disclosed in JP-A 63-17453, and the vacuum packaging materials disclosed in JP-A 4-19655 and JP-A 4-230748 can also be exemplified as suitable examples of the container material.

[Automatic Opening Device for Solid Material Package]

An automatic opening device for a solid material package will be described conceptually by reference to schematic drawings.

Figure 2:
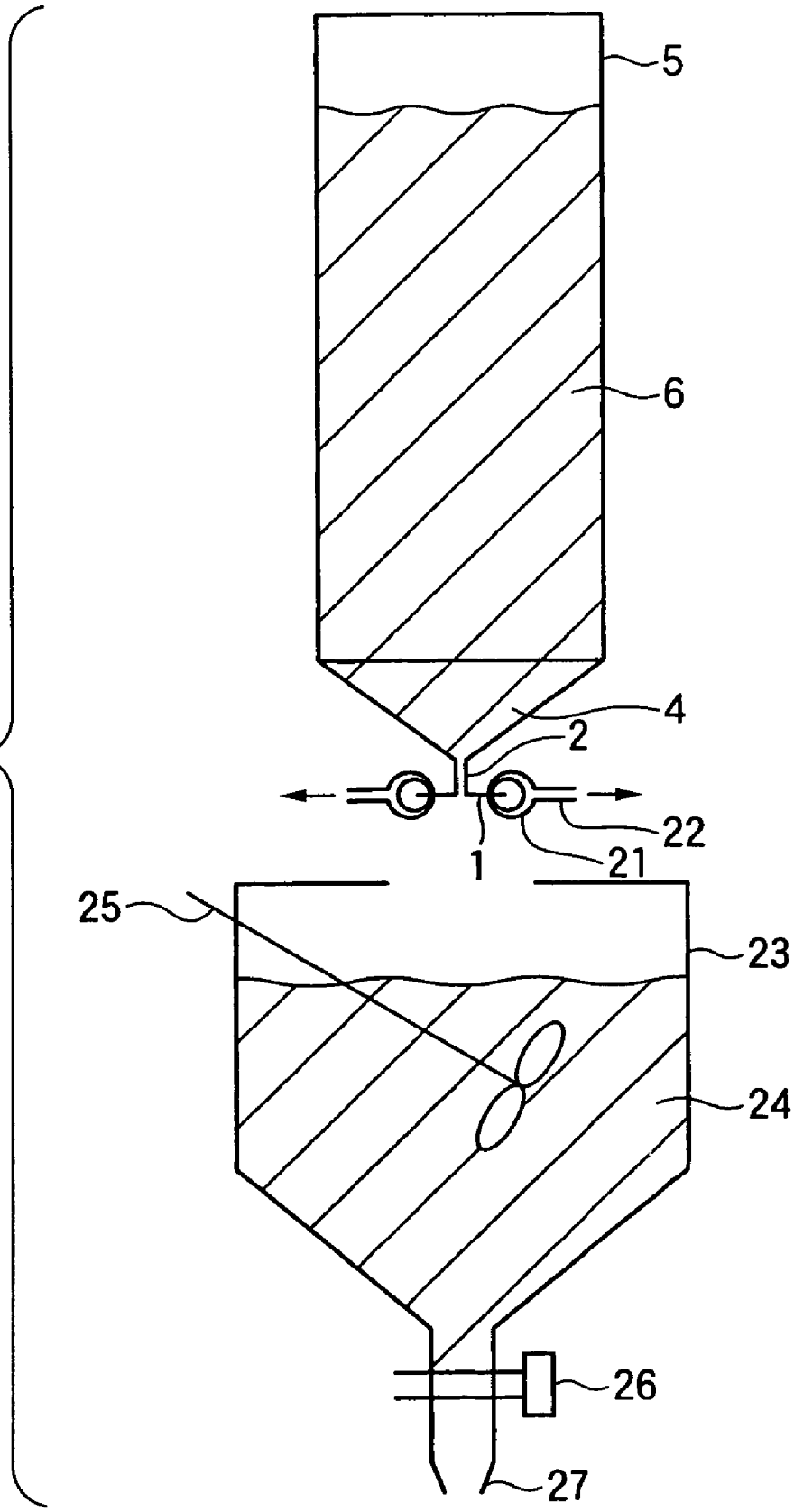
FIG. 2 is a schematic view showing a typical embodiment in which a solid material package is opened, and a solid material housed therein is discharged out of a container.

FIG. 2 is a schematic view showing a typical arrangement in which a solid material package is opened. FIG. 2 is a view for conceptually depicting a process where a package is opened and a solid material housed therein is discharged from the container. The main body 5 of the solid material package is fixed on the opening device so that the pulling flap 1 is placed at the bottom. A grip 21 is disposed at the tip of a pulling unit 22. A pair of grips 21 grips the pair of pulling flaps 1, respectively. Subsequently, a pair of pulling units 22 moves in the directions indicated by arrows, whereby the pulling units 22, and accordingly the pulling flaps 1, and further the seal section 2, are pulled to thus peel off a seal. Consequently, a solid material 6 is discharged from the container.

The thus-discharged solid material is automatically dispensed in a dissolution bath 23 such as a processing solution preparation tank in the embodiment shown in FIG. 2, whereby a solution 24 such as a photographic-processing solution is prepared. The prepared solution is sent from a discharge port 27 to a replenishment tank, a processing tank, or the like in accordance with its purpose by way of a discharge valve 26.

A process and operations in which the gable-top-type solid material package is automatically opened to discharge the solid material has hitherto been described conceptually. However, in the conventional opening method, the pair of grips 21 included in the pulling units 22 grip and pull the respective pair of pulling flaps 1 in opposite directions in a single plane. This is more apparent in FIG. 3, which shows operation of a comparative example.

Figure 3:
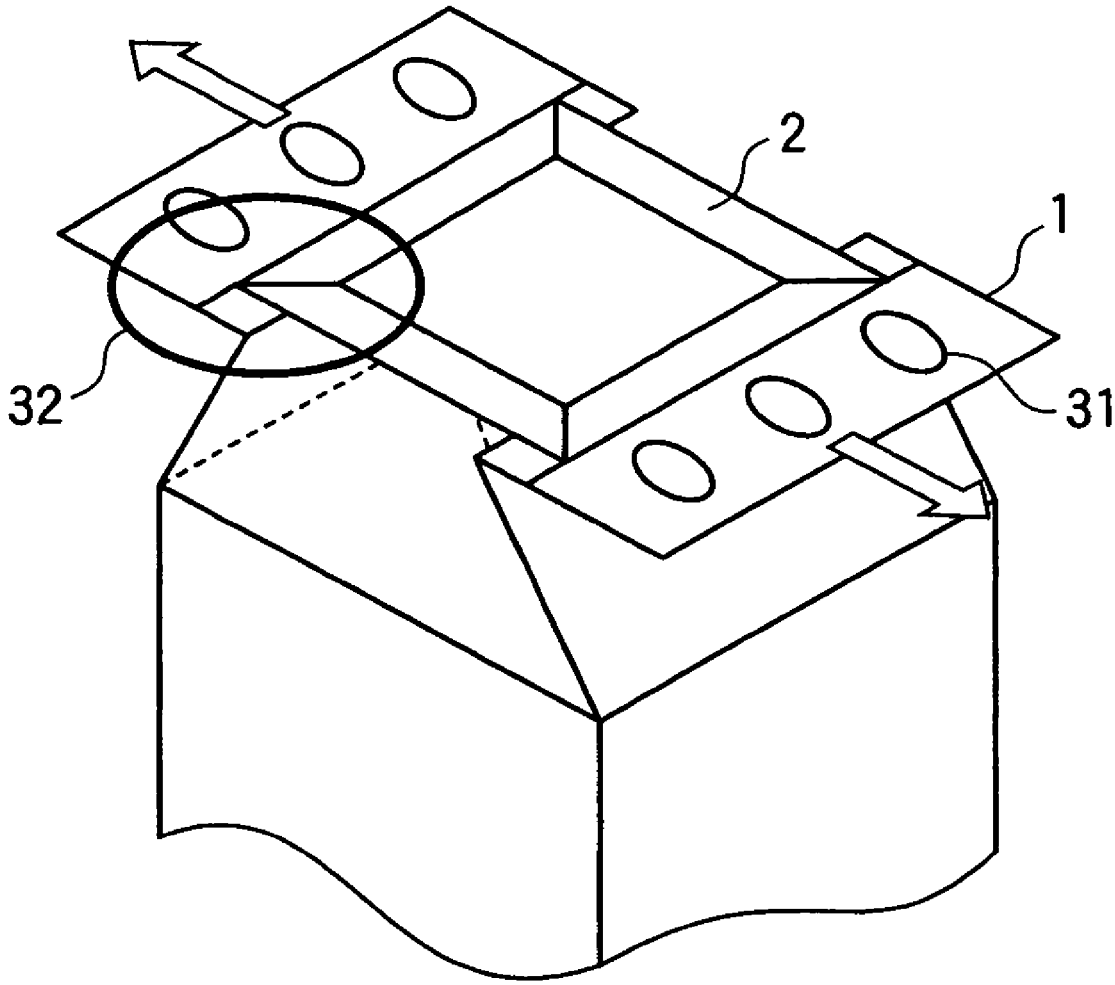
FIG. 3 is a perspective view of an opening section of the package showing the way in which a seal is peeled off in a comparative example.

FIG. 3 is a perspective view showing a way in which a seal is peeled off in the comparative example of the invention with the opening section 3 of a package on the top. The pulling directions are indicated by two arrows pointing in opposite directions. The opened result obtained by means of such a pulling is revealed such that a corner indicated with a round frame 32 in the seal section 2 is peeled off obliquely, which causes non-smooth discharge.

According to the method, since tensile stress does not act uniformly over the entire face of the pulling flap 1, stress is locally applied on a certain corner, and the seal section is peeled off in a distorted manner. Accordingly, a solid material inside the container is not discharged smoothly, resulting in splashing or occurrence of residues in the container. Solution of these problems eventually leads to the prevent invention.

Next, specific embodiments of the invention will be described.

<First Embodiment>

A first embodiment of an opening device of the invention will be described by reference to FIGS. 4 to 6.

Figure 4:
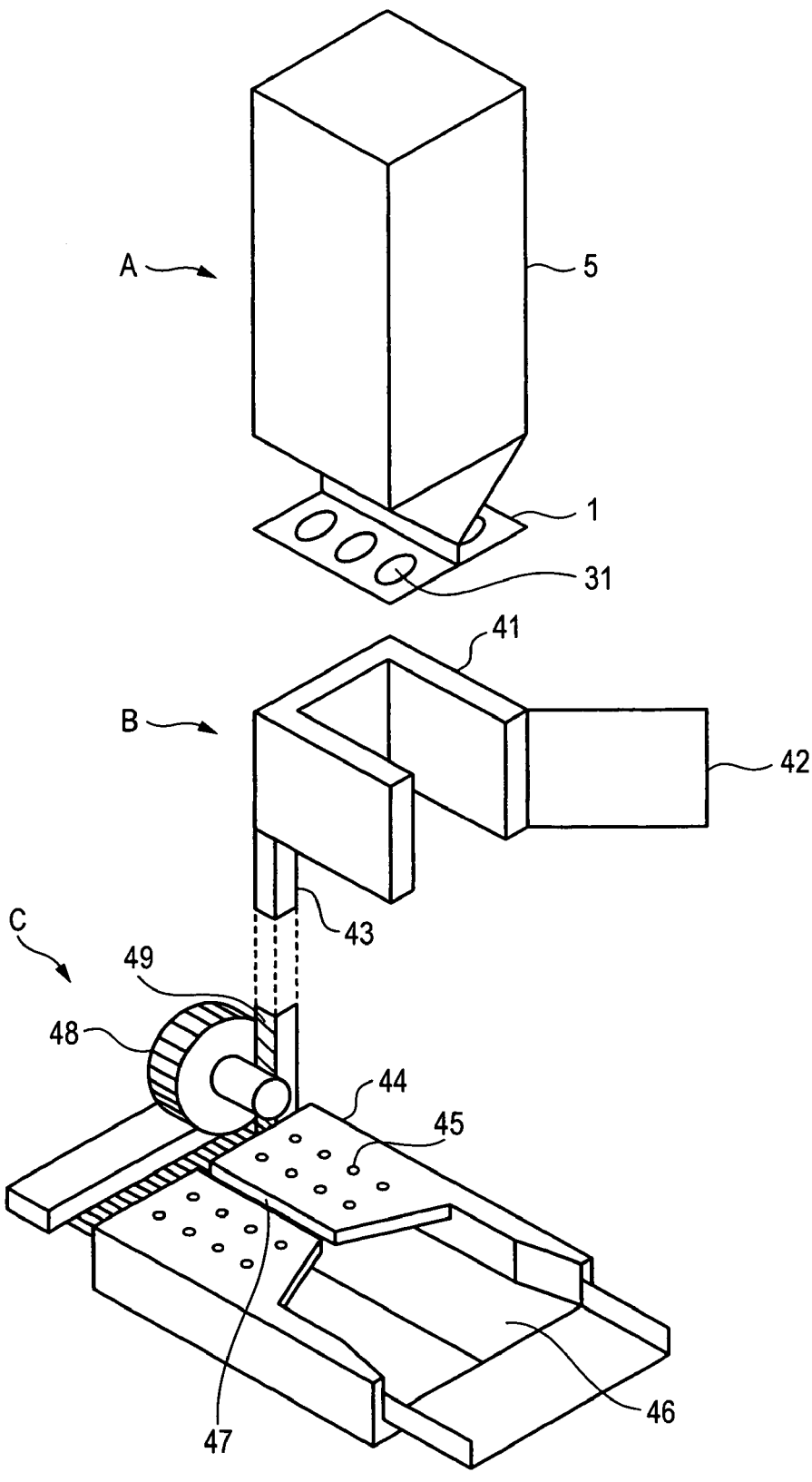
FIG. 4 is a schematic structural view showing the opening device on which a solid material package is fixedly supported.

In FIG. 4, A shows that a solid material package is attached to the opening device, wherein the package is in an inverted posture (an opening section is located at the bottom); B shows package supporting unit 41 for fixedly supporting the solid material package on the opening device; and C shows an opening mechanism which grips and pulls the opening section of the package to thus open the package and which also moves the package upward in a coordinated manner with opening of the package. In A of FIG. 4, engagement holes 31 to be gripped through engagement are formed in the pulling flap 1. In B of FIG. 4, the package main body 5 is surrounded by the fixedly-supporting units 41, and fixed to an unillustrated pillar by units of a stop 42. An elevating column 43 is disposed downward from the fixedly-supporting units 41. A rack 49 to be engaged with a gear 48 which rotates in conjunction with travel of movable pieces 44 is disposed on the side face of the elevating column 43. Each of the movable pieces 44 includes a grip 46. Protrusions 45 which fit in the engagement holes 31 to thus strengthen gripping are disposed on the surface of the grip 46. Each of the movable pieces 44 is movably positioned on a rail 51 of the pulling units while being supported by wheels 52 and 53.

Figure 5:
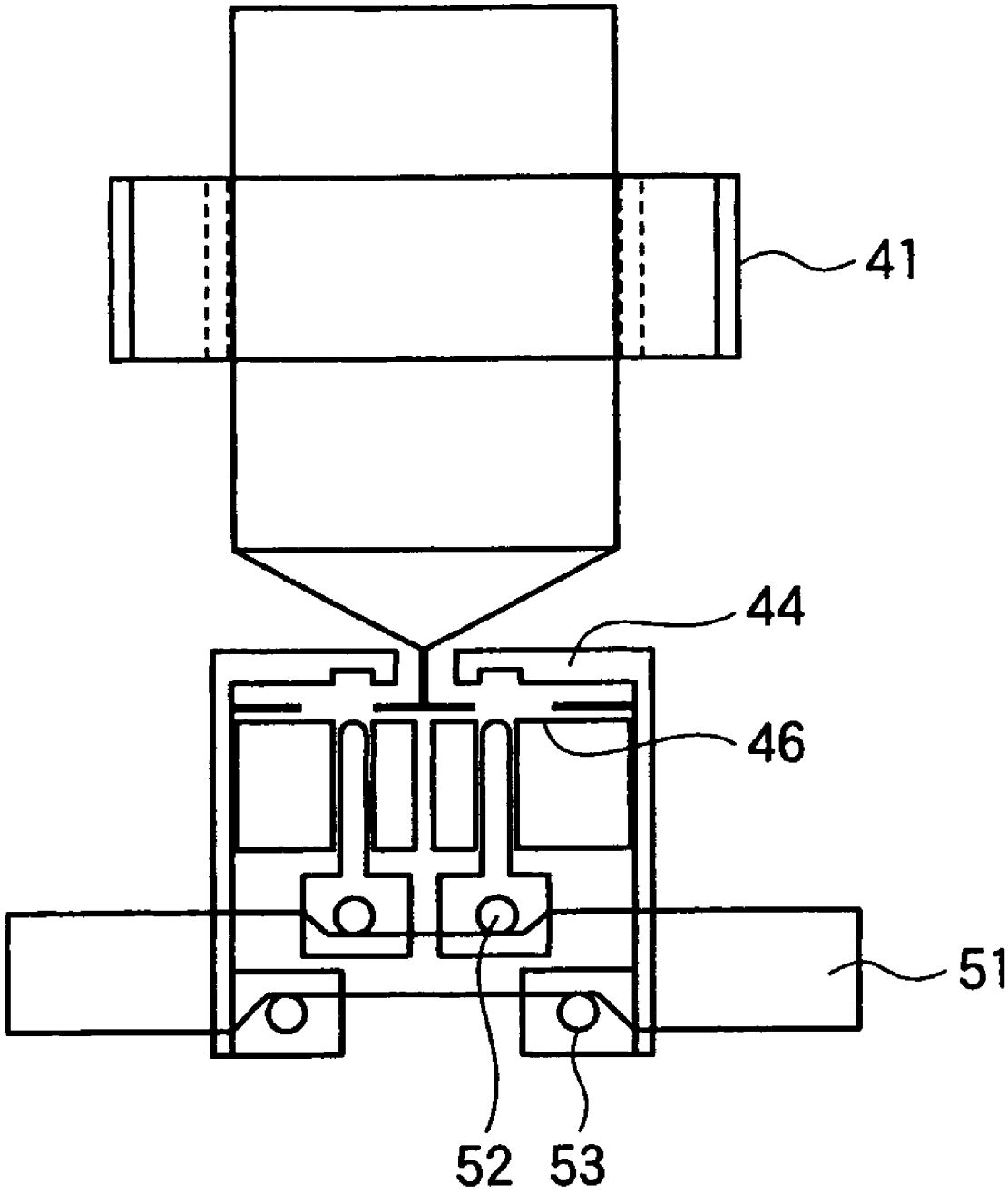
FIG. 5 is an elevation view of an opening unit supporting a package.

FIG. 5 is an elevation view of the opening unit supporting the package. As shown in FIG. 5, each of the movable pieces 44 is movably positioned on the corresponding rail 51 of the pulling units while being supported by the wheels 52 and 53. The pair of movable pieces 44 contact with each other, thereby forming a joint face 47.

Operation of the embodiment will be described. Of the solid material package, as shown in FIG. 5, the main body 5 is fixed by the package supporting unit 41. Preparation for opening is completed in a state where the sealing section 2 of the package is pinched between the joint face 47 of the movable pieces 44, and the pulling flaps 1 are gripped by the grips 46. Subsequently, when the pair of movable pieces 44 move in opposite directions, while the pair of pulling flaps 1 gripped by the grips 46 of the movable pieces 44 are pulled, the sealing section 2 is peeled off, whereby opening is effected. The solid material in the packaging container is discharged downward by way of an opened portion made by the opening. At this time, the solid material package is raised upward in conjunction with moving of the movable pieces 44 by a gear system constituted of the gear 48 connected to the movable pieces 44, the rack 49 to be engaged with the gear 48, and the elevating column 43 having the rack 49. When the roof section 4 of the package forms a plane with the main body 5, the opening is completed. The upward moving distance of the package at this time corresponds to a difference between the height of the package before the start of moving and that after completion of moving.

Figure 6:
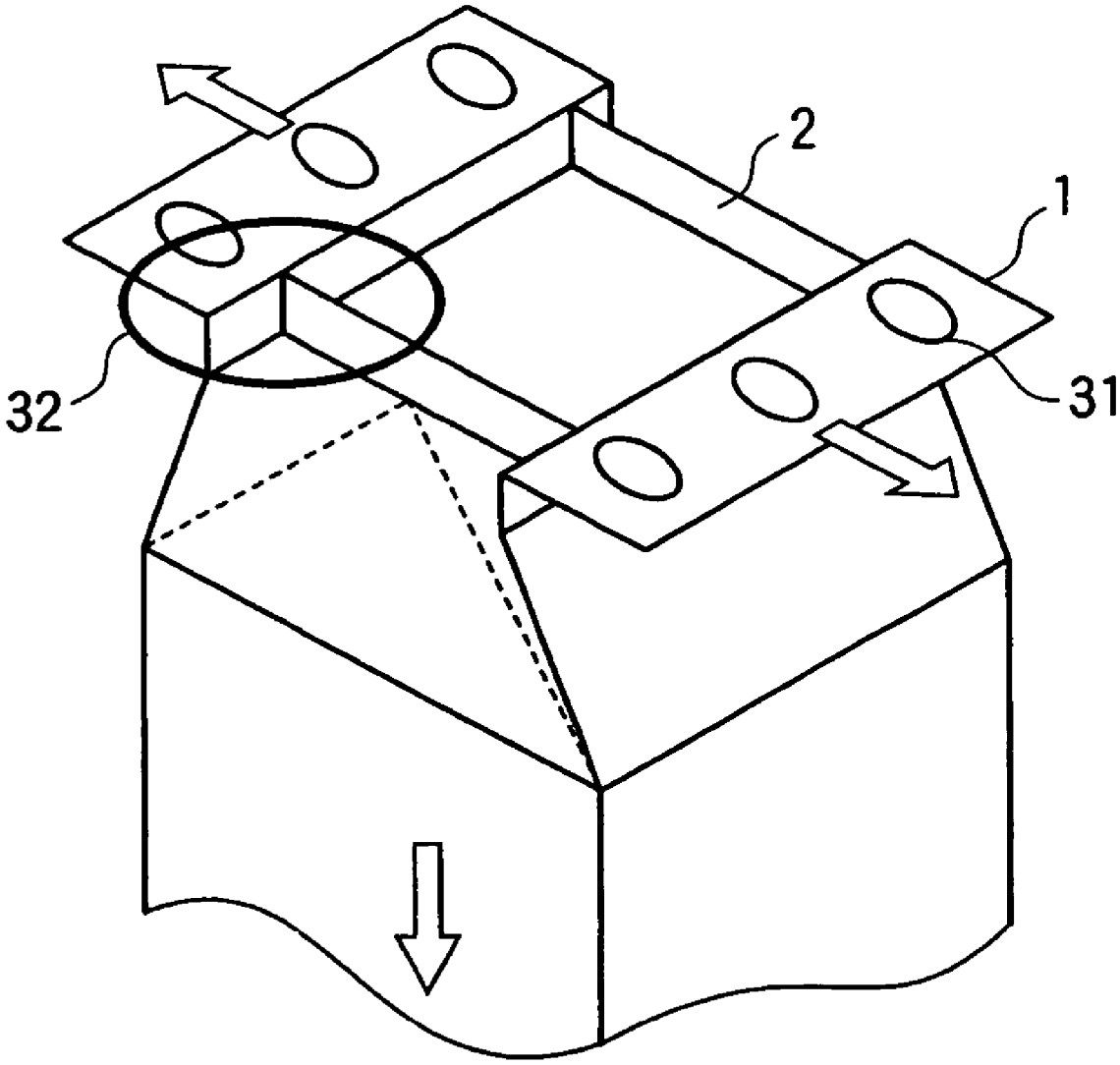
FIG. 6 is a perspective view of an opening section of a package showing the way in which a seal is peeled off in Test 1.

In FIGS. 4 to 6, pulling directions of the pulling flaps 1 are, as indicated by two arrows, opposite directions within a plane which includes the pair of pulling flaps 1 and which is perpendicular to a vertical moving direction of the solid material. However, the pulling directions of the pulling flaps 1 are not necessarily within a single plane, and can be arbitrary so long as an opening angle formed by the planes of the pair of pulling flaps 1 falls within the range of 0 to 180°.

In the embodiment where the solid material package is moved upward in conjunction with pulling action of the movable pieces 44, irrespective of a type of commercially available solid photographic-processing agent, a solid material is thoroughly discharged in a short time, and no residual chemical is recognized inside the container. In addition, splashing of the solid material does not occur. FIG. 6 shows a peeling condition of the seal section at this time. The sealing section within the round frame 32 in FIG. 6 is peeled off vertically against the sealed face. The drawing also shows that deformation which may result in incomplete discharge is not found on the container main body. In this respect, the embodiment shows distinct dissimilarities from the comparative example shown in FIG. 3.

<Second Embodiment>

A second embodiment of an opening device of the invention will be described by reference to FIGS. 7 and 8.

Figure 7:
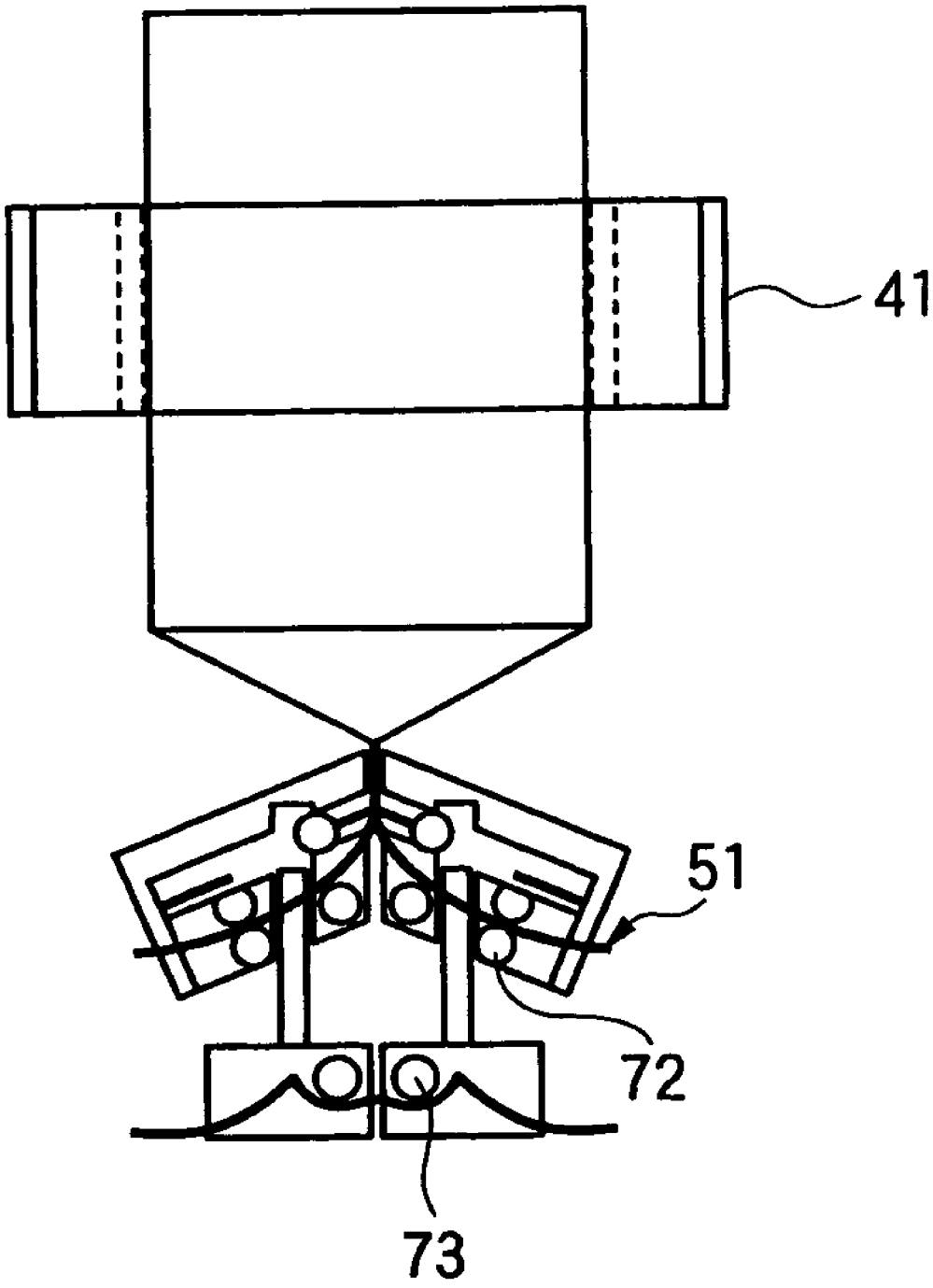
FIG. 7 is an elevation view of an opening unit supporting a package.
Figure 8:
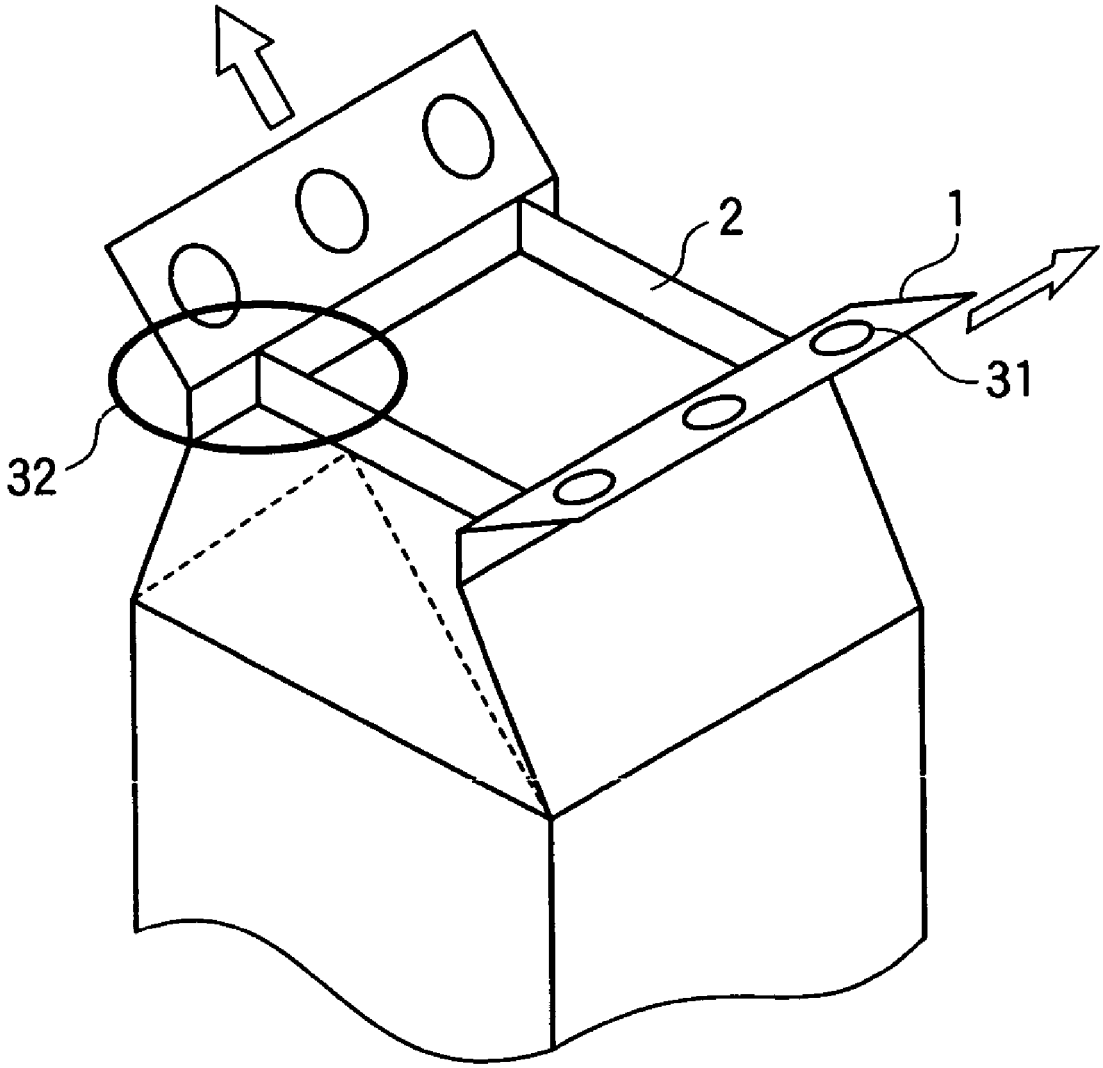
FIG. 8 is a perspective view of an opening section of a package showing the way in which a seal is peeled off in Test 2.

FIG. 7 is a view corresponding to FIG. 5 of the first embodiment. In FIG. 7, the movable pieces 44 which fixedly support the solid material package 41 onto the opening device in an inverted state, and grip and pull the pulling units 1 to thus effect opening, are shown in the lower portion of the drawing. Each of the movable pieces 44 is movably positioned on the corresponding rail 51 of the pulling units while being supported by wheels 72 and 73. The pair of movable pieces 44 are in contact with each other, thereby forming the joint face 47.

Operations of the embodiment will be described. The solid material package main body 5 is fixed by the package supporting unit 41. Preparation for opening is completed in a state that the sealing section 2 of the package is pinched between the joint face 47 of the movable pieces 44, and the pulling flaps 1 are gripped by the grips 46. Subsequently, when the pair of movable pieces 44 move in a downwardly oblique direction on the rails 51 of the pulling units while being supported by the wheels 72 and 73, and the pair of pulling flaps 1 gripped by the grips 46 of on the movable pieces 44 are pulled, the sealing section 2 is peeled off, opening is effected. In contrast to the first embodiment, the second embodiment does not include a gear system which works in conjunction with moving of the movable pieces 44, and the solid material package is not moved upward. In the embodiment, an opening angle formed by opposite faces of the pulling flaps is 120°. In such a case that peeling is performed by downward pulling, upward moving of the solid material package is not required.

In the embodiment, irrespective of a type of a commercially available solid photographic-processing agent, a solid material is thoroughly discharged within a short period of time, and no residual chemical is recognized inside the container. In addition, splashing of the solid material does not occur. FIG. 8 shows a peeling condition of the sealing section at this time. The sealing section within the round frame 32 in FIG. 8 is peeled off perpendicular to the sealed face. The drawing also shows that deformation which may result in incomplete discharge is not found on the container main body. In this respect, the embodiment shows distinct dissimilarities from the comparative example shown in FIG. 3.

Here, the grip will be described, by reference to supplemental remarks on the first and second embodiments.

The grip which grips the pulling flaps may be of an arbitrary type, so long as it is capable of gripping the pulling flap securely so as to allow peeling off of the sealing section. A preferable type makes use of a pinching jig which pinches opposite sides of the pulling flaps so as not to allow sliding.

Another preferable method is such that an engagement hole is formed in a pulling flap, and a protrusion which fits in the hole is formed in a grip.

In the above-mentioned method making use of the pinching jig, an engagement hole is preferably disposed so as to increase sliding friction as in the case of the fitting type, thereby further increasing strength of gripping the pulling flap. Alternatively, a material having a large coefficient of static friction is preferably selected for the surface of the grip.

In a modification of the fitting method, a hole is formed in a pulling flap, and a protrusion is disposed on the grip; however, the hole and the protrusion are not necessarily fitted together. An essential requirement is to provide sufficient static friction for preventing slide over a contact surface between the pulling flap and the grip.

[Solid Material]

A solid material housed in the solid material package, which is an intended object to which the opening device of the invention is applied, is a solid material of an arbitrary form of powder, granular, tablet, or the like. Preferably, the solid material is a solid photographic-processing agent. The solid processing agent may be of an arbitrary form among powder, granules, or tablets; and may be a single chemical or a mixed processing agent. Preferred forms are granular and tablet.

In addition to being applied to the powder processing agent of single constituent, powder agents are also applied to powder compositions formed by the following methods. Under one of the methods, respective constituents are pulverized by means of crushing as required so as to adjust grain sizes, or the like; and the respective powder raw materials are mixed in a prescribed ratio. Under another method, the respective constituents are dissolved in a solvent such as water, thereby being pulverized by means of an appropriate drying method such as spray drying.

Under the latter method, for instance, a powder processing agent can be manufactured in accordance with a general method as described in JP-A 54-133332, British Patent No. 725892, British Patent No. 729862, German Patent No. 3733861, and the like.

In the case of tablet, if necessary, respective constituents are pulverized as required by means of crushing so as to adjust grain sizes, or the like; and the respective powder raw materials are mixed in a prescribed ratio. There is also employed a method such that the respective constituents are dissolved in a solvent such as water, to thereby be pulverized by means of an appropriate drying method such as spray drying. If necessary, an appropriate binder is added for enhancing mechanical strength or stability of the tablet agents.

As a binder there may be employed for instance, a water-soluble binder such as a polyvinyl alcohol, a methylcellulose, or a binder described in JP-A5-333507 ([0066]).

The tablet processing agents can be manufactured, for instance, in accordance with a general method as described in JP-A 51-61837, JP-A 54-155038, JP-A 52-88025, British Patent No. 1213808, and the like. Tablets can also be manufactured in accordance with (2), (4), (5), or (6), particularly (2) and (4), of granulation methods described in "Granulation Handbook," which will be described later, as granulation methods for granular processing agents.

No particular limitation is imposed on a shape of a tablet, which may be any of spherical, tabular, disc-like, indefinite, and the like. In addition, no limitation is imposed on a size of the tablet, so long as it allows easy handling; however, the longitudinal diameter is preferably 5 to 30 mm, more preferably 8 to 20 mm.

The granular processing agents can be manufactured, for instance, in accordance with a general method as described in JP-A 2-109042, JP-A 2-109043, JP-A 3-39735, JP-A 3-39739, JP-A 2001-183780, and the like.

In the invention, the term "spherical granules" refers to granules which are formed by granulating powder into a spherical shape. The spherical shape encompasses both a perfect sphere and an imperfect sphere, as well as granular shapes generally referred to as pellet, pill, and bead. In the invention, the mean diameter of the granules is preferably 0.5 to 20 mm, more preferably 1 to 15 mm, particularly preferably 2 to 10 mm. Effects of the invention are prominent when granules whose mean diameter is 0.5 mm or smaller account for 10 wt % or less of a granular solid processing agent, particularly preferably 0 to 5 wt %.

Preferred types of a granular solid processing agent used in the invention include granules of a core-shell type and those having a multi-layered structure. When such a granular solid processing agent is employed, components which are less prone to consolidation or deliquescence can be disposed on a surface-coating layer, which brings about greater effects in attaining the object of the invention.

More specifically, as a method of granulation, there may be employed methods described in JP-A 2001-183779 ([0018] to [0027] and embodiments) and JP-A 2001-183780 ([0021] to [0028] and embodiments). As a processing agent container, there may be employed containers described in JP-A 2001-183779 ([0029] to [0033]) and JP-A 2001-183780 ([0030] to [0034]).

Granules can be formed in various shapes, such as spherical, cylindrical, prism-like, and indefinite. The mean diameter of the granules is preferably 0.1 to 10 mm, more preferably 0.2 to 8 mm, particularly preferably 0.3 to 5 mm.

Granules according to the invention can be manufactured in accordance with any of a variety of known granulation methods, including manufacturing methods for granules of a core-shell type or a multi-layered structure. A variety of granulation methods applicable to the invention are described in "Granulation Handbook" (edited by The Association of Powder Process Industry and Engineering, Japan), and are also described in, e.g., JP-A 4-221951 and JP-A 2-109043, and the like.

Surfaces of the tablet or granular processing agents may be coated with water-soluble polymers for the purpose of protecting the surfaces and enhancing solubility. No particular restriction is imposed on the type of a water-soluble polymer used for coating, and one or more polymers selected from synthetic, semisynthetic, and natural water-soluble polymers can be used. Specific examples of such polymers include gelatin, pectin, polyacrylic acids, polyacrylates, polyvinyl alcohol, modified polyvinyl alcohol, polyvinyl pyrrolidone, polyvinyl pyrrolidone/vinyl acetate copolymer, polyethylene glycol, sodium carboxymethyl cellulose, hydroxypropylmethyl cellulose, hydroxyethyl cellulose, hydroxypropyl cellulose, methyl cellulose, ethyl cellulose, alginates, xanthan gum, gum arabic, gum tragacanth, karaya gum, carrageenan, and methyl vinyl ether/maleic anhydride copolymer. Of these polymers, polyethylene glycol, polyvinyl pyrrolidone, hydroxypropyl cellulose, methyl cellulose, gum arabic, and carrageenan are preferably used singly or in combination of two or more thereof.

As a coating method for water-soluble polymers, a known method can be used without particular restrictions. However, the rolling, agitation, fluidized-bed, coating, fusion, or atomization-drying granulation process is preferably employed. A method of applying spray-coating on the surface of each granule with a 1 to 50% aqueous polymer solution, and drying the polymer is particularly preferable.

The solid processing agent according to the invention may be arbitrary solid agent, such as a color developer, agents involved in a de-silvering process (a fixing agent, a bleaching agent, a bleach-fixing agent), and a rinsing agent. In addition to the above, the solid processing agent is also applicable to a black-and-white developing agent, a reducer for use in photoengraving, a photographic-processing tank cleaning agent, and the like.

[Automatic Photographic-Processing Solution Preparation Device]

The most general object to which is applied the opening device for a solid material package of the invention is an automatic photographic processing solution preparation device. The automatic photographic processing solution preparation device—which is equipped with the automatic opening device of the invention—opens a solid material package automatically, and dispenses the solid material into a processing solution preparation tank, thereby preparing a processing solution. FIG. 2 shows the automatic photographic processing solution preparation device. The main body 5 of the package which houses the solid material 6 in the upper portion of the processing solution preparation tank (dissolution bath) 23 in FIG. 2 is opened by means such that the sealing section 2 is pulled by the grip 21 of the opening device. Accordingly, the solid material 6 is discharged, mixed, and dissolved in the solution 24, whereby a processing solution such as a replenisher is prepared. According to the opening device of the invention, a solid material can be rapidly discharged without dirtying the operator's hands, easily, and without leaving residues inside the container.

[Photosensitive Material Processing Device]

Another preferable object to which is applied the opening device for a solid material package of the invention is a photosensitive material processing device. The photosensitive material processing device—equipped with the automatic opening device—automatically opens a solid processing agent and dispenses the processing agent into a solid replenisher storage tank, whereby the solid processing agent is dispensed directly into a processing tank from the storage tank as a replenisher. In the photographic-processing device of this type, the same effect as attained in the case where water is added to the processing tank together with the solid processing agent is attained, and a stationary replenisher is replenished by means of mixing in the processing tank. For instance, in a photographic-processing device—which is disclosed in JP-A 2003-207825—of a type incorporating a solid processing agent storage tank, the opening device for a solid material package of the invention can be mounted above the solid replenisher storage tank. Accordingly, a package of a solid processing agent is automatically opened and dispensed in the solid replenisher storage tank, whereby operability can be enhanced. More specifically, an embodiment such that the opening device for a solid material package of the invention is located above the solid processing agent storage tank 100 shown in FIG. 5 of JP-A 2003-207825 so that solid materials are dispensed in the storage tank 100 as a result of opening is preferable.

Additionally, still another preferable object to which is applied the opening device of the invention is a photosensitive material processing device. The photosensitive material processing device—which includes the automatic opening device—automatically opens a solid processing agent, dispenses the solid processing agent into a replenisher preparation tank to prepare a replenisher, sends the thus-prepared replenisher to a replenishment tank, and performs replenishment from the replenishment tank to a processing tank.

EXAMPLES

Experimental results obtained with use of the opening devices described in the first and second embodiments are described below. However, the invention is not limited to the devices shown in the embodiments.

[Solid Processing Agent]

The experiment used the granular color developer of test number 5 in Table 1 in Example 1 of JP-A 2001-183779 which had been prepared in accordance with the descriptions about the embodiments of the specification.

[Solid Material Container]

As a solid material container, a gable-top-type container made of a sheet material having a structure of PE/paper/PE/aluminum foil/PET/PE/PEF was used. The main body of the container is of a prism-like shape having a cross-section of 85 mm square and a height of 250 mm. The roof section thereof is 50 mm in extended length, 10 mm in sealed width of the opening section, and 30 mm in width of the pulling flap.

Furthermore, constituent materials of the laminated material included paper of BKP (bleached kraft pulp) having a basis weight of 300 g, PE of stretched LDPE (low density polyethylene) sheet of 60 μm thickness for every PE, aluminum foil having a thickness of 12 μm, PET having a thickness of 12 μm, and PEF having a thickness of 12 μm.

[Solid Material Package]

The container, which housed 1,500 g of the granular processing agent, was subjected to heat sealing with use of a commercially-available heat-hardening adhesive with a sealing pressure of 1 t under 370° C., thereby preparing a solid material package.

[Testing Conditions]

Test 1

With use of the opening device of the first embodiment, an opening test was repeatedly performed with an opening angle formed by the pulling flaps of 180°, and sealing temperatures of 300° C. and 370° C., 3 times each.

As an evaluation method for the test results, there was conducted an overall evaluation inclusive of tensile strength (i.e., opening strength) required for opening, and visual observation of shapes of seal sections at the time of opening.

The opening strength was determined by use of a commercially available tensile tester (Orientec Tensilon RTA-1T).

Results of visual observation of the shape of the seal section was classified as follows. When one of the four corners A, B, C, and D of the peeled-off sealing section of the opening was such that a peeled-off line was parallel with the side face of the container as shown in FIG. 6, the shape was determined to be "good"; when the peeled-off line departed from parallel and in such a condition as indicated with the round frame 32 in FIG. 3, it was determined to be "poor"; and an intermediate condition between "good" and "poor" was determined to be "fair."

The results are shown in Table 1 (in Tables 1, 2, "n" indicates the number of repetitions).

TABLE 1

Relationship between Sealing Temperature and Opening in Parallel Opening (n = 3)

| Opening Angle (°) | Sealing Temperature (° C.) | Opening Strength Kgf | A | B | C | D | Total | Remarks |
|---|---|---|---|---|---|---|---|---|
| 180 | 300 | 3.25 | good | good | good | good | good | |
| 180 | 300 | 2.90 | good | good | good | good | good | |
| 180 | 300 | 2.45 | good | good | good | good | good | |
| 180 | 370 | 10.17 | fair | fair | good | good | good | Slightly poor, but insignificant. |
| 180 | 370 | 7.57 | good | good | good | good | good | |
| 180 | 370 | 7.92 | good | good | good | good | good | |

In the embodiment, visual observation of the corners A and B was classified as "fair" once each; however, all the results of visual observation other than these were "good." Opening strength fell within an appropriate range, and all the repetitions indicated favorable opened conditions.

Test 2

The opening device of the second embodiment was used. Opening angles formed by the pulling flaps were 40° and 90°, and sealing temperatures were 300° C. and 370° C.

Evaluation was conducted in accordance with the same evaluation method as used in Test 1. The results are shown in Table 2.

TABLE 2

Relationship Between Sealing Temperature And Opening in Oblique Opening (n = 3)

| Opening Angle (°) | Sealing Temperature (° C.) | Opening Strength Kgf | A | B | C | D | Total | Remarks |
|---|---|---|---|---|---|---|---|---|
| 40 | 300 | 3.60 | good | good | good | good | good | |
| 40 | 300 | 3.90 | good | good | good | good | good | |
| 40 | 300 | 3.74 | good | good | good | good | good | |
| 40 | 370 | 10.00 | good | good | good | good | good | |
| 40 | 370 | 10.00 | good | good (exfoliated) | good | good | good | No problem of exfoliation |
| 40 | 370 | 9.70 | good | good | good | good | good | |
| 90 | 300 | 3.80 | good | good | good | good | good | |
| 90 | 300 | 3.00 | good | good | good | good | good | |
| 90 | 300 | 3.60 | good | good | good | good | good | |
| 90 | 370 | 10.92 | good | good | good | good | good | |
| 90 | 370 | 9.45 | good | good | good | good | good | |
| 90 | 370 | 8.55 | good | good | good | good | good | |

The results of visual observation were all "good," the opening strength fell within an appropriate range, and all the repetitions indicated favorable opened conditions.

Furthermore, the same tests as Tests 1 and 2, were conducted, except that the granular bleach-fix processing agent of test number 6 in Table 3 in Example 3 of JP-A 2001-183779 which had been prepared in accordance with the description thereof was used as the solid processing agents. The results of opening in the tests were favorable, as in the case where the granular color developer was filled in the solid material package.

The present invention is not limited to the specific above-described embodiments. It is contemplated that numerous modifications may be made to the present invention without departing from the spirit and scope of the invention as defined in the following claims.

This application is based on Japanese Patent application JP 2004-016614, filed Jan. 26, 2004, the entire content of which is hereby incorporated by reference.

What is claimed is:

1. An opening device for a solid material package comprising:

a package supporting unit for fixedly supporting a main body of the solid material package having a pair of pulling flaps;

an opening unit comprising grips for gripping the pair of pulling flaps so that an opening angle formed by the pair of pulling flaps is 10° to 180°, a pair of movable pieces for supporting the grips, and pulling units for pulling the pair of movable pieces to open the package; and a moving unit for moving the package supporting unit upward only a distance corresponding to a difference between a height of the package in a completely-opened state and that before opening, in conjunction with moving of the opening unit, wherein the solid material package is caused to move upward as the movable pieces grip the pulling flaps with the grips and the pulling units pull the movable pieces within the opening angle, whereby a seal section of the solid material package is peeled off and then the solid material is discharged from the package.

2. The opening device according to claim 1, wherein the solid material package is a prism-like container in which a solid material is housed, and the solid material package has at a top of the solid material package an opening section provided with the seal section and the pair of pulling flaps formed by means of extending a top-side outer edge of the seal section.

3. The opening device according to claim 2, wherein the solid material housed in the solid material package is a solid photographic-processing agent.

4. The opening device according to claim 1, wherein each of the grips is a pinching jig that pinches opposite sides of the pulling flap so as not to allow sliding.

5. The opening device according to claim 1, wherein each of the grips is a jig having a protrusion that fits in a hole formed in the pulling flap.

6. The opening device according to claim 1, wherein the opening device serves as supply means of solid material for use in a device for preparing a photographic-processing solution.

7. The opening device according to claim 1, wherein the opening device serves as supply means of replenisher for use in a photographic-processing device.

8. An opening device for a solid material package comprising:

a package supporting unit for fixedly supporting a main body of the solid material package having a pair of pulling flaps; and an opening unit comprising grips for gripping the pair of pulling flaps so that an opening angle formed by the pair of pulling flaps is 10° to 120°, a pair of movable pieces for supporting the grips, and pulling units for pulling the pair of movable pieces to open the package, wherein the movable pieces grip the pulling flaps with the grips and the pulling units pull the movable pieces outwardly and downwardly within the opening angle, whereby a seal section of the solid material package is peeled off and then the solid material is discharged from the package.

9. The opening device according to claim 8, wherein the solid material package is a prism-like container in which a solid material is housed, and the solid material package has at a top of the solid material package an opening section provided with the seal section and the pair of pulling flaps formed by means of extending a top-side outer edge of the seal section.

10. The opening device according to claim 9, wherein the solid material housed in the solid material package is a solid photographic-processing agent.

11. The opening device according to claim 8, wherein each of the grips is a pinching jig that pinches opposite sides of the pulling flap so as not to allow sliding.

12. The opening device according to claim 8, wherein each of the grips is a jig having a protrusion that fits in a hole formed in the pulling flap.

13. A device for preparing a photographic-processing solution, comprising the opening device according to claim 8 as supply means of solid material.

14. A photographic-processing device comprising the opening device according to claim 8 as supply means of replenisher.

* * * * *